United States Patent [19]

Brachet et al.

[11] Patent Number: 4,580,969

[45] Date of Patent: Apr. 8, 1986

[54] FURNACE COMPONENT CONSTITUTING A PASSAGE FOR GASES ESCAPING FROM A BURNER AND A PROCESS FOR OBTAINING THIS

[75] Inventors: Pierre Brachet, Versailles; Claude Gehin, Metz, both of France

[73] Assignees: Societe Lorraine de Laminage Continu-Sollac, Florange; Lafarge Refractaires, Montrouge, both of France

[21] Appl. No.: 688,701

[22] Filed: Jan. 4, 1985

[30] Foreign Application Priority Data

Jan. 13, 1984 [FR] France ..... 84 00535

[51] Int. Cl.[4] ..... F23M 9/00

[52] U.S. Cl. ..... 431/171; 126/39 K; 126/99 D

[58] Field of Search ..... 126/39 E; 431/168–172, 431/186, 336, 114–116; 126/39 K, 99 D

[56] References Cited

U.S. PATENT DOCUMENTS

| | | | |
|---|---|---|---|
| 3,315,726 | 4/1967 | Williams | 431/346 X |
| 3,748,087 | 7/1973 | Shular | 431/186 X |
| 3,868,212 | 2/1975 | Lemaire | 431/171 |
| 4,451,230 | 5/1984 | Bocci et al. | 431/186 X |

*Primary Examiner*—Larry Jones

*Attorney, Agent, or Firm*—Bierman, Peroff & Muserlian

[57] ABSTRACT

The invention relates to furnaces equipped with an insulating inner lining formed from fibers. The object of the invention is to reduce the thermal discontinuities at the level of the orifice tube of the burner. For this purpose, the orifice tube consists of blankets of fibers arranged radially round the burner and compressed to a greater extent in the inner part facing the axis of the burner than in the outer part. The density in the inner part preferably reaches 300 to 400 kg/m$^3$.

12 Claims, 4 Drawing Figures

FURNACE COMPONENT CONSTITUTING A PASSAGE FOR GASES ESCAPING FROM A BURNER AND A PROCESS FOR OBTAINING THIS

BACKGROUND OF THE INVENTION

1. Field of the Invention

The present invention relates to an improvement in a construction process for furnaces having walls which are thermally insulated as a result of the use of refractory fibers, and more specifically to an improvement in the process in which these refractory fibers are installed according to the technique called "blanket on edge".

2. Description of the Prior Art

In this technique, blankets or flexible slabs of ceramic fibers are cut into strips which are subsequently stacked on top of one another, so as to constitute a wall, the thickness of which corresponds to the cut-out outline of the strips and the faces of which are formed by the strip edges stacked on one another.

In furnaces heated with a liquid or gaseous fuel, for example natural gas, heat is supplied by means of burners, these being devices in which there occurs the combustion reaction of the fuel mixed with air providing the oxygen necessary for the reaction. An industrial burner consists of a usually metal part which is located outside the furnace and in which the two fluids (fuel and oxidant) are introduced under the requisite conditions for the reaction and sometimes for their mixing, and of a second part which is called the burner orifice tube or combustion tunnel and in which the combustion reaction takes place.

Because of the temperature stresses to which this orifice tube is subjected, it must both be refractory and have good thermal insulation to maintain at this location the highest possible temperature to ensure good combustion of the fuel/oxidant mixture, whilst at the same time withstanding thermal shock, this last point being the most difficult to achieve.

Since the ideal material has not yet been discovered, most burner orifice tubes are usually made of dense refractory bricks or concrete, this being the best compromise at the present time. the burner, itself located outside the furnace, to the interior of the latter, where the combustion products are released, it is placed in the thickness of the wall, forming an unusual point in it. When the wall is made of ceramic fiber, the burner orifice tubes made of relatively heavy material (concrete or brick) have many sensitive points which are difficult to connect to the rest of the wall and of which the performances as regards stability and insulation vary greatly.

Orifice tubes are sometimes composed of formed pieces made from ceramic fibers molded in a vacuum. However, the results obtained are uneven as regards temperature stresses and stresses both thermal and mechanical (erosion as a result of the velocity of the hot gases) which often exceed the resistance performances of the molded pieces. Moreover, the slightest overheating causes uncontrolled shrinkage cracks, and at length this damages the burner orifice tube because scales and even entire parts of burner blocks become detached.

The object of the invention is to provide a burner orifice tube or combustion tunnel, the thermal properties of which are close to those of the adjacent wall obtained by the technique of "blanket on edge", and which is connected effectively to the latter, but nevertheless has high resistance to the difficult conditions prevailing at the level of a burner.

Another object of the invention is to provide a process for obtaining such a component.

GENERAL DESCRIPTION OF THE INVENTION

The present invention therefore provides a furnace component constituting a passage for gases escaping from a burner and travelling towards the interior of the furnace, this furnace component constituting a burner orifice tube or combustion tunnel, which is formed from ceramic fibers and the main particular feature of which is that it consists essentially of continuous layers of blankets of refractory fibers, these layers being adjacent along planes passing substantially through the axis of the component and being the more compressed, the nearer they come to the axis.

Preferably, the compression of the layers of refractory fibers of the outer side of the component, that is to say the side furthest away from the axis of the burner, is close to that of the fibers constituting the rest of the furnace lining, and the compression of the layers of fibers on the inner side, that is to say the side nearest to the axis of the burner, is at least 100% greater than that of the fiber layers on the outer side, preferably 200 to 300% greater. Thus, on the outer side, this results in a practically continuous connection between the characteristics of the component and those of the rest of the lining and in a gradual transition to a density and therefore a resistance to erosion which is much higher when the inner side is reached.

Components possessing excellent insulation properties and resistance to thermal shocks are obtained in this way. In the event of overheating, shrinkage occurs in the thickness of the blankets, but it cannot produce cracks parallel to the wall of the furnace and there is therefore no risk that the burner will be destroyed as a result of scaling.

A process according to the invention for obtaining such a component involves the following stages:

(a) a retaining member, comprising a rigid sleeve having inner dimensions corresponding substantially to the outer dimensions of the component, is arranged in the plane of the furnace wall, and a base is arranged perpendicularly to the sleeve, (b) a compression assembly comprising two radial flanges mounted rotatably on the axle of the sleeve is arranged in the retaining member, (c) radial layers, obtained when blankets of fibers are cut into a shape corresponding to a radial half-section of the component to be obtained, are placed next to one another in the retaining piece, (d) the installed layers are compressed when one radial flange is rotated relative to the other, and filling is completed when other radial layers are added in the space left free as a result of the rotation of the flanges, (e) the compression assembly consisting of the radial flanges is removed.

The above operations are preferably carried out with the axis of the sleeve being vertical. The sleeve subsequently serves for transporting the orifice tube to install it finally in the furnace.

In a first embodiment, the sleeve is made of metal, and in this case it can be removed after the orifice tube has been installed in the furnace, and can be recovered if appropriate. It can also be left in place.

In a second embodiment, the sleeve consists of a tube made of molded ceramic fibers, and it can be left in place in the wall.

BRIEF DESCRIPTION OF THE DRAWINGS

The invention will now be described in more detail by means of a practical exemplary embodiment illustrated in the drawings, wherein.

DESCRIPTION OF PREFERRED EMBODIMENT

Figure 1:
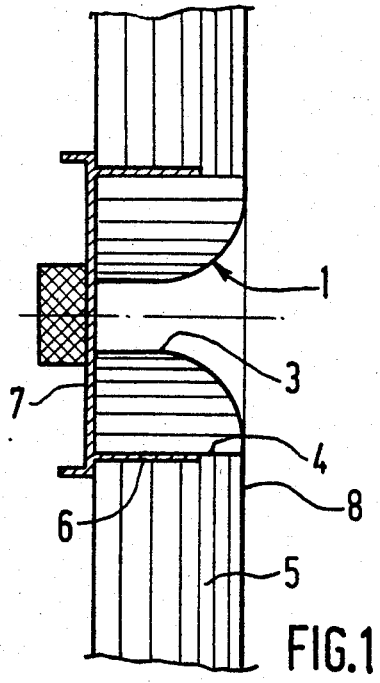
FIG. 1 is a view in axial section of an orifice tube according to the invention.
Figure 2:
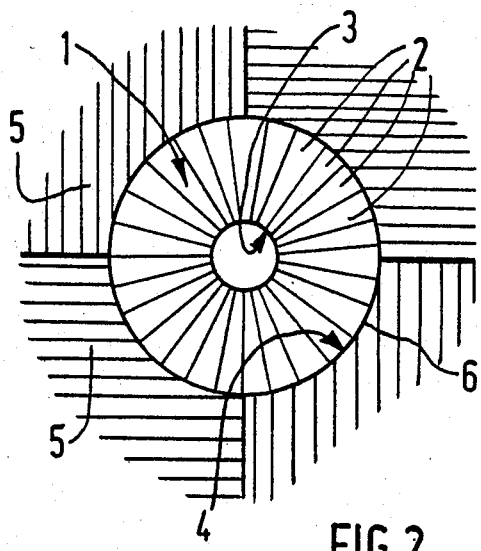
FIG. 2 is a front view of the same orifice tube.

The orifice tube 1 described in FIGS. 1 and 2 consists of strips of blankets of ceramic fibers 2 cut out according to a cross-section of the orifice tube to be obtained and arranged radially. The capacity of the ceramic fiber to be compressed according to the stress which it undergoes ensures that, during assembly, each portion becomes a sector of variable thickness, maximum compression being obtained on the inner wall of the orifice tube, and it is this which constitutes the originality of the process and reduces subsequent shrinkage on the hottest face of the orifice tube.

In practice, compression is such that the apparent density of the fiberous material in the vicinity of the inner face 3 of the orifice tube is greater than 250 kg/m$^3$, preferably 300 to 400 kg/m$^3$, thus giving this zone a resistance to erosion which is considerably greater than that of the fiberous material in the vicinity of the outer face 4 of the orifice tube, this being of the order of 130 kg/m$^3$, nearing that of the fiberous blankets 5 of the rest of the lining.

FIG. 1 shows that the orifice tube is retained at its periphery by a sleeve 6 which is formed from a sheet-metal cylinder and which is fastened to the metal part 7 of the burner. The height of the sleeve 6 is less than the thickness of the orifice tube, being approximately two thirds of the latter, and it is offset towards the outside of the furnace, with the result that it does not reach the inner surface 8 of the furnace.

In an alternative form, the sleeve consists of a tube made of molded ceramic fibers, this making it possible to ensure greater thermal uniformity of the wall by means of a construction which is a little more expensive.

In another alternative form, the sleeve, which serves essentially for retaining the orifice tube during the storage and transport of the latter from the place of manufacture to its final location, is eliminated or disappears after the fiberous material of the orifice tube has been installed. In this case, this fiberous material continues to be maintained by the rest of the fiber lining. To achieve this result, there can be, for example, a sleeve having a height which is at least partially greater than the thickness of the fibers, thus allowing it to be extracted when it is pulled towards the interior of the furnace. It can also be made of a material which disappears during first heating, for example plastic.

Even when the sleeve is not intended to disappear, it is advantageous to ensure that the face of the orifice tube turned towards the outside of the furnace is connected to the metal part of the burner or to the outer wall of the furnace by means of a suitable glue or cement or by means of a suitable attachment device, for example metal fastening elements anchored in the fibers.

It will be noted that, in FIGS. 1 and 2, the inner face 3 and outer face 4 of the orifice tube are in the form of a cylinder of circular cross-section. It is possible to provide inner or outer cross-sections of different forms, for example elliptical for the inner face and square for the outer face.

In particular, when the furnace is insulated as a result of the assembly of elements of fiberous material in parallelepipedic form, it is advantageous to give the orifice tube an outer shape compatible with that of these elements, that is to say a rectangular contour, the dimensions of which are the same as those of these elements or a multiple of the latter.

Figure 3:
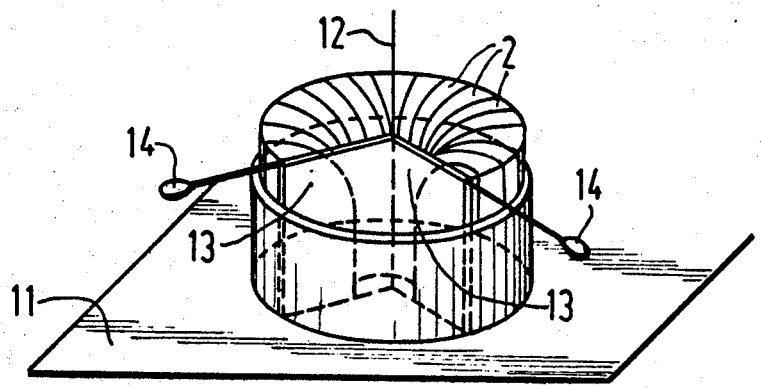
FIG. 3 is a perspective diagram of the device for producing the orifice tube according to the invention.
Figure 4:
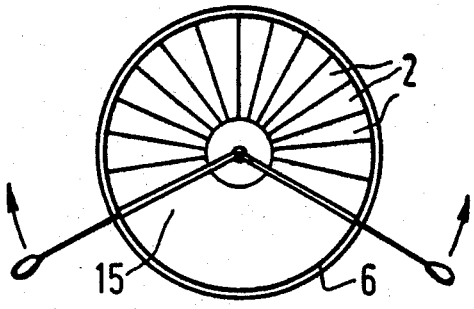
FIG. 4 is an axial view of the same device.

The method of producing the orifice tube of FIGS. 1 and 2 is illustrated in FIGS. 3 and 4.

The apparatus incorporates a horizontal support 11, on which a vertical rod 12 forming an axle is mounted. Two metal plates or flanges 13 are mounted so as to pivot about the rod 12, these plates being vertical in a plane containing the rod 12. They are each provided with a handle 14. It is possible to remove the plates 13 by means of their handles, when they are made to slide upwards along the rod 12.

To produce an orifice tube according to the invention with this apparatus, a jacket 6 is first placed over the support 11, so that its axis of symmetry coincides with the rod 12, and it is immobilized, for example by means of a few welding spots. The plates 13 are subsequently brought up against one another, and the sleeve 6 is then filled with blankets 2 of fibers, which are arranged radially, while being compressed slightly or without being compressed. These blankets have previously been cut out according to a design corresponding to the section shown in FIG. 1. When the sleeve 6 is full, the two plates 13 are moved apart from one another, thus compressing the fibers 2 already installed, whilst at the same time freeing an empty space 15 between the faces of the plates 13 which until then were up against one another. This situation is that which can been seen in FIGS. 3 and 4. The space 15 is subsequently filled with new blankets 2 also arranged radially, after which the plates 13 are removed by being made to slide upwards along the rod 12. The effect of this operation is to equalize the compressions between the blankets 2 installed in two different stages of the process.

The sleeve 6 is subsequently separated from the support 11, for example when the welding spots are broken, and the orifice tube is ready to be transported to the place of use.

When the form of the orifice tube is not circular, it is easy to modify the process accordingly: if the inner face of the orifice tube is not circular, this is taken into account by a variation in the form of the blankets 2 when they are first cut out. If the outer form is square or rectangular, the corners of the sleeve 6 can be lined in advance with blankets of fibers. If it is envisaged that the orifice tube will be retained by means of metal fastening elements, such as those described in the document No. FR-A-2,507,594, these are advantageously installed at the moment when the blankets of fibers 2 are placed in the sleeve 6.

What is claimed is:

1. A furnace component consisting of a flaring portion for gases escaping from the burner and traveling toward the interior of the furnace, said flaring portion being formed of ceramic fibers and being defined in that it consists essentially of continuous layers of blankets of refractory fibers, said layers being adjacent along planes passing substantially through the axis of the component and being increasingly compressed as they approach this axis.

2. A component according to claim 1, wherein said flaring portion is surrounded by a sleeve intended to make it easier to retain the blankets of fibers at least until the component is finally installed in the furnace.

3. A component according to claim 2, wherein the sleeve does not reach the inner surface of the furnace, after the component has been installed.

4. A component according to claim 2, wherein the sleeve is formed from a tube made of molded ceramic fibers.

5. A component according to claim 2, wherein the sleeve projects at least partially beyond the inner surface of the furnace after the component has been installed, thus allowing it to be removed.

6. A component according to claim 2, wherein the sleeve is made of a material which disappears during first heating.

7. A component according to claim 1 and intended for obtaining a component for a furnace which is insulated as a result of the assembly of elements of parallelepipedic form, the said component having a contour in the form of a square or rectangle, and of which each outside dimension is that of the insulation elements or a multiple of this.

8. A component according to claim 1 which, on its face intended to be opposite the interior of the furnace, is equipped with metal elements for fastening the furnace component, these elements being anchored in the fibers.

9. A method for manufacturing a furnace component consisting of a flaring portion for gases escaping from a burner wherein:

(a) a retaining member, comprising a rigid sleeve having inner dimensions corresponding substantially to the outer dimensions of the component, is arranged in the plane of the furnace wall, and a base is arranged perpendicularly to said sleeve, (b) a compression assembly comprising two radial flanges mounted rotatably on the axle of said sleeve is arranged in the retaining member, (c) radial layers, obtained when blankets of fibers are cut into a shape corresponding to a radial half-section of the component to be obtained, are placed next to one another in the retaining member, (d) the installed layers are compressed when one radial flange is rotated relative to the other, and filling is completed when other radial layers are added in the space left free as a result of the rotation of the flanges, (e) the compression assembly consisting of the radial flanges is removed.

10. A process according to claim 9, wherein, before or during stage (c), metal elements fastening the component to the furnace are installed, these elements being anchored in the fibers.

11. A furnace component consisting of a flaring portion for gases escaping from the burner and traveling toward the interior of the furnace, this flaring portion being formed from ceramic fibers and being defined in that it consists essentially of continuous layers of blankets of refractory fibers, these layers being adjacent along planes passing substantially through the axis of the component and being increasingly compressed as they approach this axis, said flaring portion being surrounded by a sleeve which is intended to retain the blankets of fibers at least until the component is finally mounted into the furnace, and does not reach the inner surface of the furnace after the component has been mounted into said furnace, said sleeve being formed of molded ceramic fibers.

12. A furnace component consisting of a flaring portion for gases escaping from the burner and traveling toward the interior of the furnace, this flaring portion being formed from ceramic fibers and being defined in that it consists essentially of continuous layers of blankets of refractory fibers, said layers being adjacent along planes passing substantially through the axis of said component and being increasingly compressed as they approach this axis, said flaring portion being surrounded by a sleeve which is intended to make it easier to retain the blankets of fibers at least until the component is finally mounted into the furnace, and does not reach the inner surface of the furnace after the component has been mounted into said furnace, said sleeve being made of a material which disappears during first heating.

* * * * *